US006178703B1

(12) United States Patent
Noone et al.

(10) Patent No.: US 6,178,703 B1
(45) Date of Patent: Jan. 30, 2001

(54) ROOFING TILE, ROOF AND METHOD OF ASSEMBLING

(75) Inventors: Michael J. Noone, Wayne, PA (US); William C. Woellner, Athens, OH (US)

(73) Assignee: CertainTeed Corporation, Valley Forge, PA (US)

( * ) Notice: Under 35 U.S.C. 154(b), the term of this patent shall be extended for 0 days.

(21) Appl. No.: 08/129,615

(22) Filed: Oct. 5, 1993

(51) Int. Cl.[7] ..... E04D 1/16

(52) U.S. Cl. ..... 52/100; 52/536; 52/542; 52/543

(58) Field of Search ..... 52/100, 535, 536, 52/542, 547, 548, 543

(56) References Cited

U.S. PATENT DOCUMENTS

| | | | | |
|---|---|---|---|---|
| 185,632 | * | 12/1876 | Elbreg | 52/542 |
| D. 276,273 | | 11/1984 | Shaw . | |
| D. 281,536 | | 11/1985 | O'Donnell . | |
| D. 281,908 | | 12/1985 | Olsson . | |
| D. 282,288 | | 1/1986 | Bates . | |
| D. 294,064 | | 2/1988 | Hansen . | |
| D. 302,732 | | 8/1989 | Ferland . | |
| 430,363 | * | 6/1890 | Babcock | 52/535 |
| 522,686 | * | 7/1894 | Donaldson et al. | 52/536 |
| 530,119 | * | 12/1894 | Niederlaender | 52/536 |
| 773,230 | | 10/1904 | Seested . | |
| 953,939 | * | 4/1910 | Arnold et al. | 52/536 |
| 1,226,888 | | 5/1917 | Hughes et al. . | |
| 3,579,940 | * | 5/1971 | Greenleaf | 52/542 |
| 4,015,391 | * | 4/1977 | Epstein et al. | 52/542 X |
| 4,890,432 | | 1/1990 | Shepherd . | |
| 4,899,514 | * | 2/1990 | Brookhart, Jr. | 52/535 X |
| 5,060,444 | * | 10/1991 | Paquette | 52/535 |
| 5,070,671 | | 12/1991 | Fifield et al. . | |

FOREIGN PATENT DOCUMENTS

| | | | | |
|---|---|---|---|---|
| 224414 | * | 10/1959 | (AU) | 52/536 |
| 56955 | * | 12/1891 | (DE) | 52/535 |
| 2204151 | * | 8/1973 | (DE) | 52/536 |
| 1708994 | | 1/1979 | (DE) . | |
| 300934 | * | 9/1965 | (NL) | 52/535 |

* cited by examiner

*Primary Examiner*—Carl D. Friedman
*Assistant Examiner*—Kevin D. Wilkens
(74) *Attorney, Agent, or Firm*—Paul & Paul

(57) ABSTRACT

A lightweight, preferably clay roofing tile, preferably having surface configurations to simulate the thick heavyweight of natural slate, or to simulate natural wood shakes, or other natural materials, is provided, constructed so as to be molded from materials with weight-reducing zones, and strengthening webs, integral with the tile, such that each tile is of unitary, molded, one-piece construction. The placement, type and number of webs enable the cutting of the tiles to form tile accessory pieces, at ends of laid-up courses, hips, ridges and the like, to minimize or eliminate the necessity of inventorying large numbers of special accessory pieces. The webs provide strengthening while the hollow zones reduce weight, with at least some of the webs being located to provide strength to the tiles along newly cut edges. An interlock design at tile edges facilitates reduction in weight by eliminating the need for a double coverage overlap. A series of bosses with depressions facilitate nailing when the tile is cut at an angle to form hip pieces.

19 Claims, 6 Drawing Sheets

ROOFING TILE, ROOF AND METHOD OF ASSEMBLING

BACKGROUND OF THE INVENTION

In the art of roofing with tiles constructed of natural materials, it has been known for many years to roof tiles with natural slates. Such slates, derived from quarries, are cut to size, drilled or punched with nail holes, and applied to roofs in a conventional manner. However, such natural slates, while providing for roofs for many years, often 50–100 years, generally require a basic supporting roof structure capable of withstanding great amounts of weight, such as on the order of 2,000 lbs. per square, with a square being a 10 feet by 10 feet area of a roof.

Synthetic products have been developed which simulate natural-appearing roofs, such as slate roofs, but such are either very heavy, or if weight is a consideration, rather thin, being constructed thinner than natural slate or other natural roofing tiles, in order to reduce the weight required.

Other synthetic roofing products have been developed, such as from molded concrete with appropriate lightweight fillers, sometimes with partial recesses for weight reduction purposes.

Such prior art synthetic products either have not simulated the desired thickness of natural materials, or have not lent themselves to being cut, thereby making it necessary to have accessories in the form of custom hip and ridge tiles, custom rake edge tiles, and various custom angled pieces, in order to complete a roof. In such instances, while a vast majority of tiles necessary to comprise a roof may be the basic roof tile, the very large number of accessory pieces that must be stocked in order to accommodate the various roofing situations that arise are often prohibitively expensive and cumbersome, adding to the cost of a synthetic, natural-appearing tile roof.

SUMMARY OF THE INVENTION

The present invention is directed to providing a one-piece roofing tile, preferably formed of a molded clay material, so as to simulate a natural appearing tile, with the tile having hollowed zones or recesses for weight reduction, and strengthening webs to provide support for the tile in the installed, on-roof condition.

It is a further object of this invention to accomplish the above object, wherein the webs are located in such a manner in the tile that various tile accessories may be cut from the tile, for left and right rakes, for hips and ridges, and for various other cuts, including angled cuts, while adequately strengthening the tile.

It is yet another object of this invention to provide a molded, preferably clay tile with interlocking lip-and-groove constructions at the sides of adjacent tiles, for resisting rain infiltration to a roof.

It is yet another object of this invention to accomplish the above objects, wherein roofs are constructed from such tiles.

It is yet another object of this invention to provide a roof of clay tile construction, wherein a tile of a generally singular configuration may be used to provide the basic tiles for the roof, as well as to provide, when cut, the necessary accessory tiles for the roof.

It is a further object of this invention to provide a roof constructed of tiles, that will have preferred low levels of weight per roofing square, while simulating natural roofing materials.

It is yet another object of this invention to provide a novel method of constructing a roof, from tiles of the type described in the objects set forth above.

Other objects and advantages of the present invention will be readily apparent upon a reading of the brief descriptions of the drawing figures, detailed descriptions of the preferred embodiments, and the appended claims.

BRIEF DESCRIPTION OF THE DRAWING FIGURES

DETAILED DESCRIPTION OF THE PREFERRED EMBODIMENTS

Figure 1:
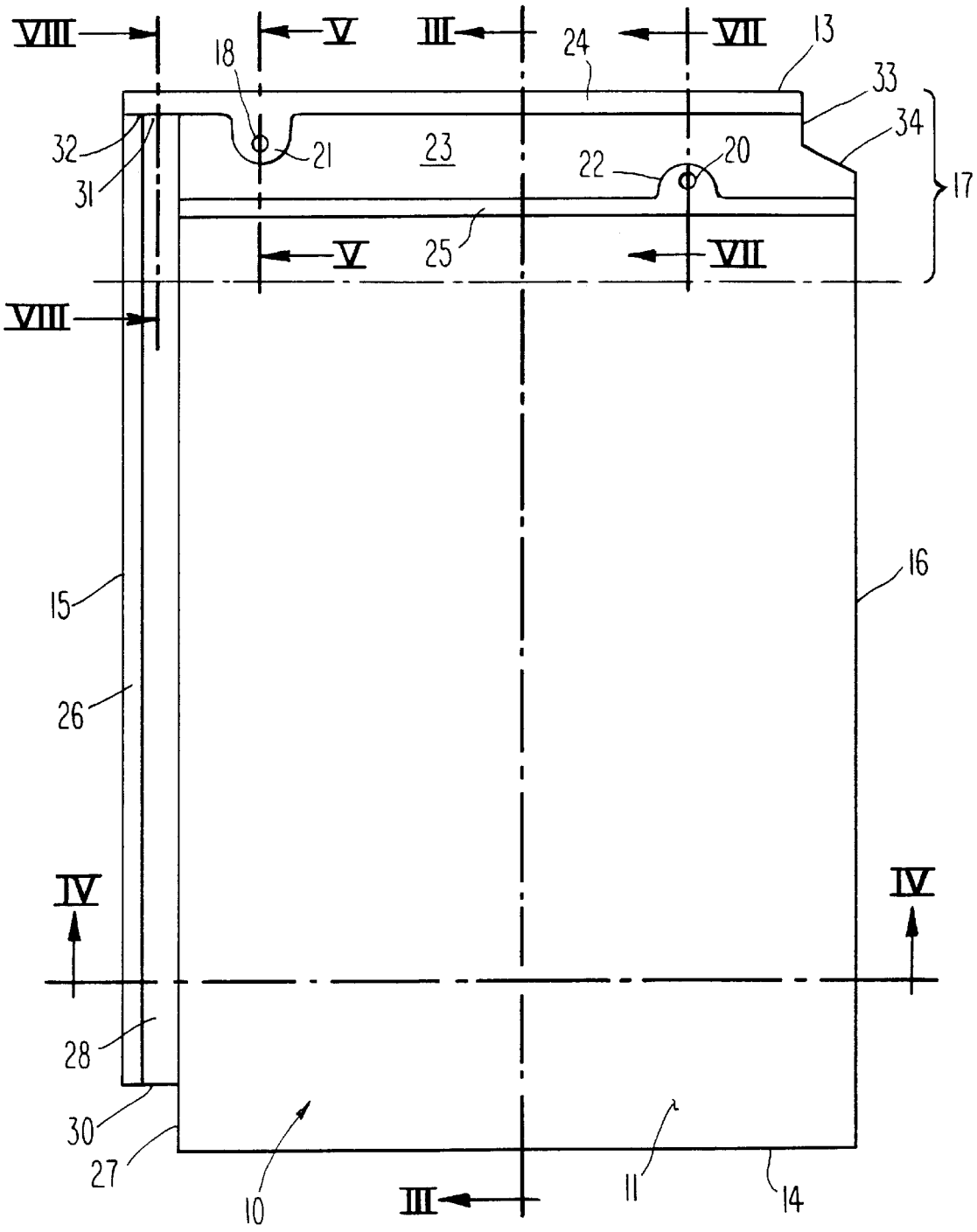
FIG. 1 is a top plan view of a tile in accordance with this invention.
Figure 2:
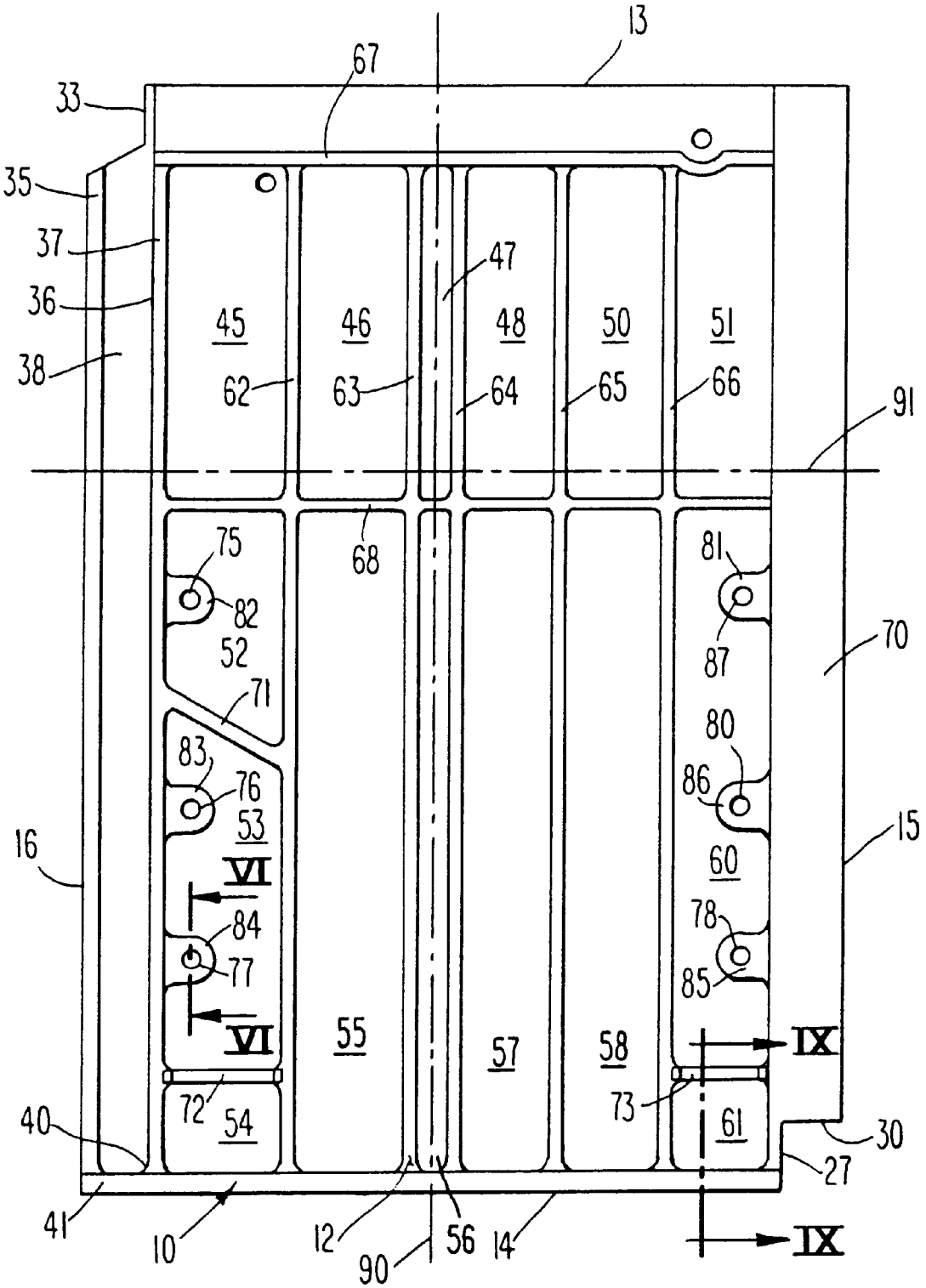
FIG. 2 is a bottom view of the tile of FIG. 1, wherein the various ribs and bosses are specifically illustrated.
Figure 3:
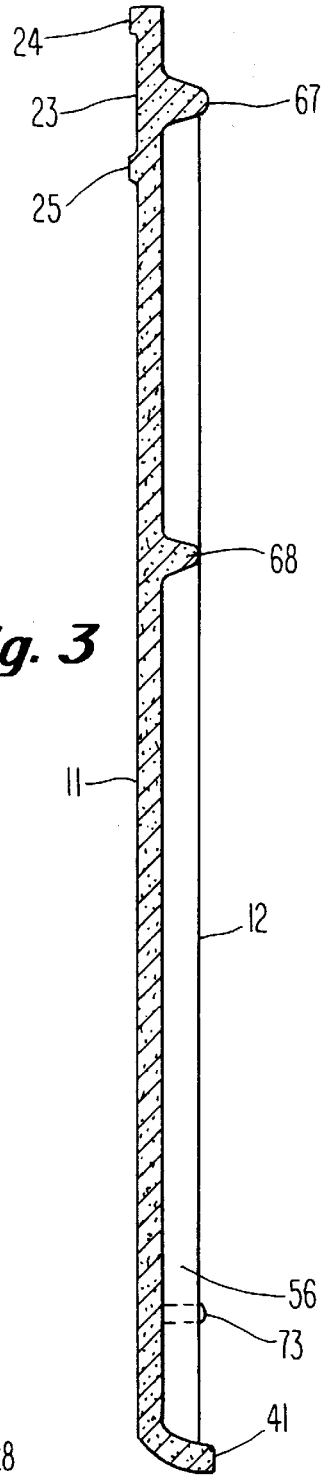
FIG. 3 is a longitudinal sectional view, taken through the illustration of FIG. 1, generally along the line III—III of FIG. 1.
Figure 5:
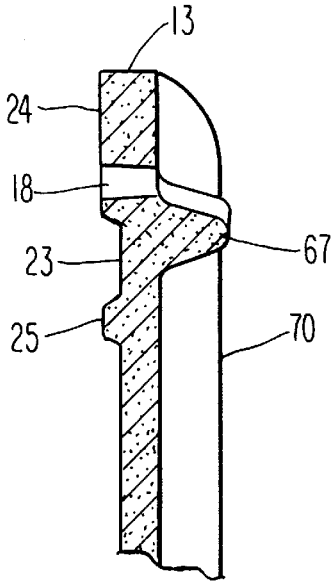
FIG. 5 is a fragmentary sectional view taken through one of the nail holes of the tile of FIG. 1, taken along the line of V—V of FIG. 1.
Figure 6:
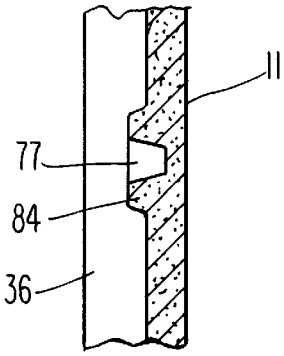
FIG. 6 is an enlarged fragmentary sectional view, taken through one of the incomplete nailing zones and related bosses, taken generally along the line VI—VI of FIG. 2.

Referring now to the drawings in detail, reference is first made to FIG. 1, wherein a tile in accordance with this invention is generally designated by the numeral 10, illustrated in top plan view, and wherein the same tile is illustrated in FIG. 2 in bottom plan view. The tile has top and bottom surfaces 11, 12, respectively, connected by upper and lower edges 13, 14, respectively, and left and right (as viewed from FIG. 1) side edges 15 and 16, respectively.

The top 15%–20% of the shingle comprises the headlap portion 17, which, in the installed condition, with an exposed portion of a next overlying tile disposed over the headlap portion 17, is not visible, because the said exposed portion covers it. Within the headlap portion 17, there are a pair of nail holes 18, 20, for nails (or other suitable fasteners) securing the tiles 10 to a roof, with the nail holes 18, 20 extending completely through the tiles. The nail holes 18, 20, are reinforced by upstanding bosses 21, 22, protruding above the surface 23, for the purpose of reinforcing the nail holes 18, 20, and for providing additional material for the nails that are disposed therein and which carry the tiles 10 to "grab" against. The bosses 21, 22, each merge with their respective horizontally disposed upstanding ridges 24, 25, extending across the tile between respectively associated sides 15, 16 thereof. The ridges 24, 25 provide shields against wind-swept rain from being driven under the tab edge of a next-overlying tile (not shown), to shield the tile against rain passing over the top edge 13 thereof, onto the wood or other underlainment of the roof (not shown).

The left edge 15 of the tile 10 is provided with an upstanding lip 26 spaced from the parallel edge 27 of the tile by a longitudinal groove 28. The lower end of the groove 28 ends at 30, and the upper end 31 of the groove ends at upstanding surface 32 of protruding ridge 24. The right edge 16 of the tile, at the upper end, has a cut-back portion 33, terminating in a champferred portion 34, as shown, such that when a right edge portion 16 of a tile 10 is disposed along the left edge 27 of a next-adjacent tile, the cut-back portions 33, 34 will not interfere with the left-most edge of the upstanding protrusion 24, at the upper left-most side of the tile, as shown.

With particular reference to FIG. 2, it will be seen that the bottom surface 12 of the tile 10 is provided with a downwardly extending lip 35, spaced from the cut-back edge 33 and the parallel edge 36 of web 37, by a groove 38.

Figure 11:
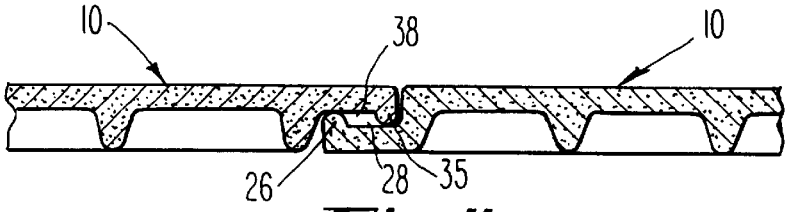
FIG. 11 is an enlarged sectional view, taken through the interlock of a pair of tiles in accordance with this invention, generally along the line of XI—XI of FIG. 10.

It will be seen that, as a pair of adjacent tiles are assembled, upstanding lip 26 will fit in groove 38, and downwardly extending lip 35 will fit in groove 28, in interlocked relation, as shown in FIG. 11. The lower left corner of tile 10 as viewed in FIG. 1 has the indicated cut-back portions 27, 30, to avoid interference with the lower end 40 of groove 38, and downwardly protruding lower edge 41 of an adjacent like tile 10, when tiles 10 are interlocked as shown in FIG. 11.

The tile as viewed in FIG. 2 is provided with a plurality of hollow zones, in the form of recesses 45, 46, 47, 48, 50, 51, 52, 53, 54, 55, 56, 57, 58, 60 and 61, as shown in FIG. 2, which zones are recessed in the lower surface 12 of the tile as shown in FIG. 2, and which zones or recesses are provided in the tile for purposes of weight reduction, in order to remove heavy material therefrom. However, it will also be apparent that hollow zones in other forms, other than recesses could be provided, such as hollow zones between upper and lower surfaces of the tiles, not visible from either surface.

However, in the embodiment illustrated in FIG. 2, it will be seen that a plurality of webs 62, 63, 64, 65 and 66 run longitudinally between upper transverse web 67 and lower transverse lip 41, as shown, and that a transverse web 68 connects the vertical webs 37, 62, 63, 64, 65, 66 and the flange 70. It will also be noted that angled web 71, and short transverse webs 72 and 73 are located as shown. Each of the webs facilitates reinforcement and support, for strengthening the tile against breakage during assembly and during its presence on a roof, particularly due to the presence of the hollow zones or recesses in the tile. Such strengthening webs also facilitate resistance of the tile to breakage when in use on a roof, by strengthening the tile for supporting workman, roofers or the like, walking on tiles on a roof, for resisting breakage upon a tile being struck by tree limbs and the like, etc.

It will be understood that in a preferred embodiment, in which the tiles are of unitary, one-piece construction, all of the webs, complete or incomplete nailing bosses and the like, and all other portions of the tile, are part of the integral, one-piece molded construction.

On both sides of the tile, there are provided as shown in FIG. 2, incomplete potential nailing zones 75, 76, 77, 78, 80 and 81, each with its associated upstanding reinforcing boss 82, 83, 84, 85, 86, 87 associated therewith, for reinforcing the incomplete nailing zones associated therewith. It will be understood that incomplete nailing zones comprise partial recesses as viewed in FIG. 2, but that they do not extend through to the top surface 11 of the tile as viewed in FIG. 1, but may be readily punched or drilled through, at the site (in situ) of assembly of the tiles onto a roof structure.

Figure 4:
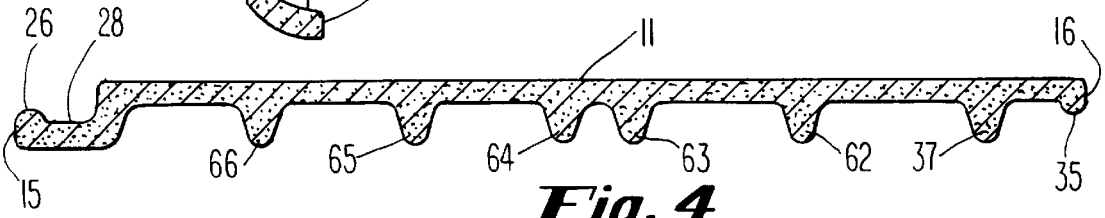
FIG. 4 is a transverse sectional view, taken through the illustration of FIG. 1, taken along the line IV—IV of FIG. 1.
Figure 7:
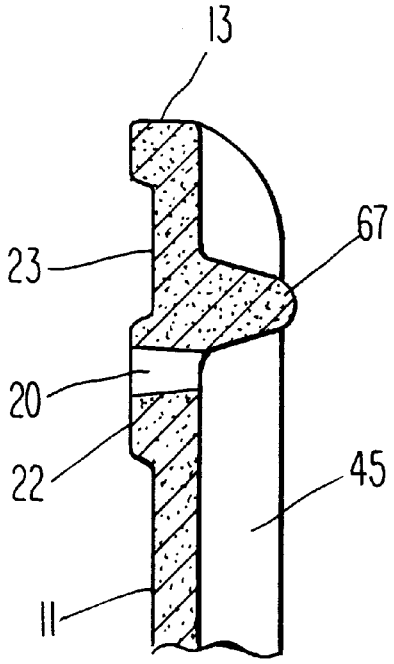
FIG. 7 is a somewhat enlarged, fragmentary sectional view, taken along the line VII—VII of FIG. 1, through one of the nail holes thereof.
Figure 8:
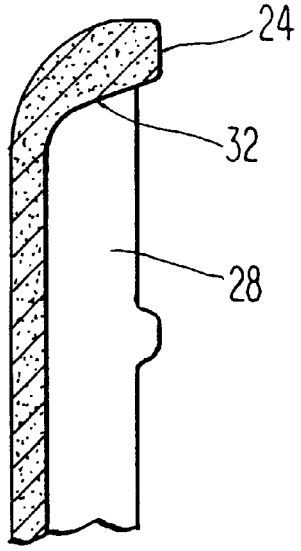
FIG. 8 is an enlarged, fragmentary sectional view, taken through the headlap portion of the shingle of FIG. 1, generally along the line of VIII—VIII of FIG. 1.
Figure 9:
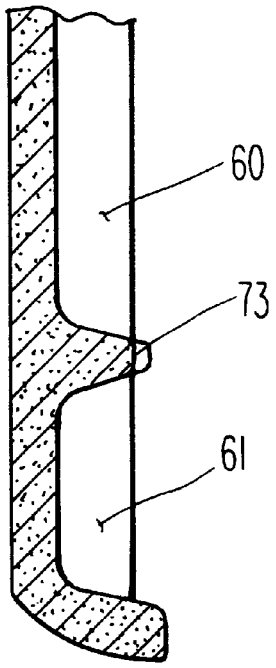
FIG. 9 is an enlarged, fragmentary sectional view, taken generally along the line of IX—IX of FIG. 2.
Figure 10:
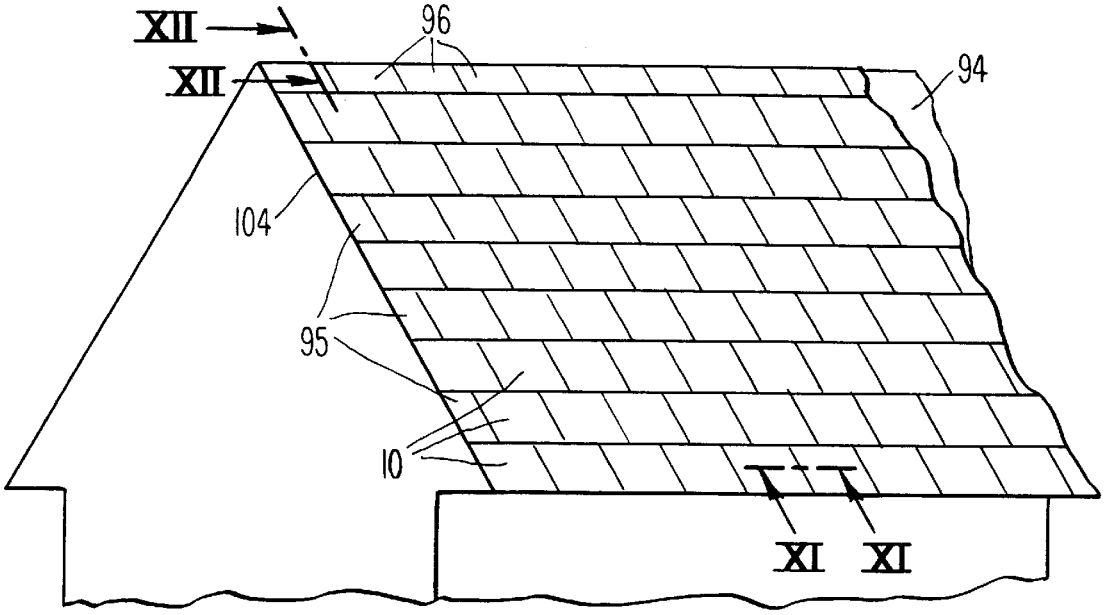
FIG. 10 is a perspective view of a roof having tiles in accordance with this invention applied thereto.

It will be seen that, as a course of tiles is being laid along a roof, if one comes to the end of a roof, and only a half tile, like those 95 of FIG. 10, is needed as measured from side-edge to side-edge, the tiles 10 in accordance with this invention can readily be cut along the common cut line 90 approximately mid-way between the pair of parallel webs 63, 64, formed by the arcuate, generally inverted U-shaped configuration defined by the cut line and the adjacent parallel converging web sides shown at the center of the FIG. 4 and each portion of tile remaining after the severing of the tile along cut line 90 will be provided with a web 63 or 64, for reinforcing and strengthening a tile adjacent its then-cut edge. Similarly, as one runs the courses of tiles from the lower edge of a roof, up toward the upper end of a roof, if the last course of tiles requires a tile, like those 96 of FIG. 10, shorter than the full height of a tile, the tiles can be cut near the web 68, in a horizontal direction as viewed in FIG. 2, along an imaginary cut line 91, leaving the lower portion of tile remaining having a reinforcing web 68 near its then-cut edge, as well, as can be seen, for example, in FIG. 12. Similarly, cuts can be made along any of the other webs, such as those 62, 65, 66, 71, 72, 73, with such webs providing reinforcement and support when left in the portion of the tile that is to be used on the roof.

Furthermore, even where unusual cuts are required, such as at peculiar angles, such that a particular edge may not have a web extending parallel therealong, there are sufficient webs and portions of webs as is apparent from FIG. 2, that a reasonable amount of reinforcement will always be provided.

It will be apparent from the foregoing, that the molded tiles will be preferably constructed of clay, and will be fired for purposes of curing the tiles and to provide structural integrity prior to their being used. It will also be provided that the exterior surfaces of the tiles, such as those viewed from, for example FIG. 1, and the exterior of the bottom edge 14, as well as other small surfaces, may, if desired, be provided with patterns, edge detail relief zones and the like, to simulate different natural effects, such as different natural slates, and that various colors can be provided, added to the clays during their mixing or applied to their surfaces before firing, to achieve permanently-fired coloring and/or ceramic coatings. The double webs 63, 64 allow for splitting the tile to provide finishing pieces for both left and right rake edges. The web 68 is particularly beneficial in providing strength and a guide for cutting a ridge cap from the tile. The incomplete nailing zones 75, 76, 77, 78, 80 and 81 may be drilled or punched through, to provide facility for nailing when the tile is cut at an angle, as for example, to form hip pieces.

A simulated slate tile in accordance with the present invention may be on the order of about 10 inches (exclusive of flange 70) by about 15½ inches in size, and within a range of about ½ inch thick to 1 inch thick, and more preferably about ¾ inch thick, weighing approximately 5 lb. per tile, and when applied to a roof will ordinarily have a weight of 450 lbs.–650 lbs. per square, and generally less than 600 lbs. per square, with a square being a unit of measurement of 10 feet by 10 feet, as distinguished from natural slate, which for a comparable thickness of tiles, would have a weight in excess of 2,000 lbs. per square.

It will also be apparent that by the recessed and webbed construction shown, tiles in accordance with this invention will have a greater apparent tile thickness, which will allow at their interlocking lips 26, 35 and grooves 28, 38, a greater depth of interlocking groove, so as to provide a great resistance to penetration of wind-driven rain at side joints.

Referring now to FIG. 10, specifically, it will be seen that a roof 94 is tiled with a plurality of tiles 10, some of which like the tiles 95 and 96, are smaller, portions of tiles, resulting from cuts that have been made along webs such as those 63, 64, 68 or otherwise, with adjacent tiles 10 being in interlocked relationship as shown at 11, along their side edges.

Figure 12:
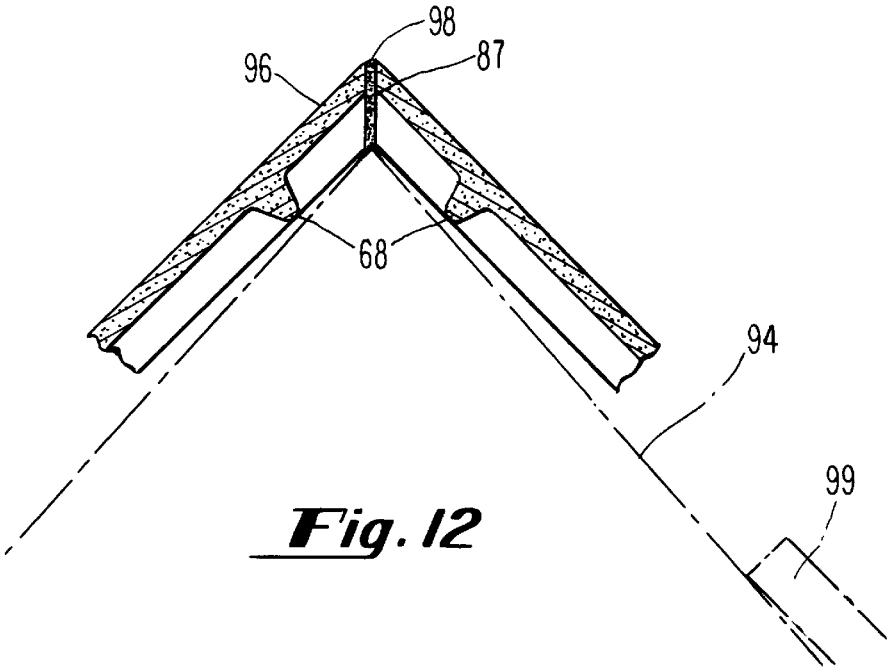
FIG. 12 is an enlarged, fragmentary sectional view, taken through the tiles on opposite sides of the apex of a roof, generally along the line XII—XII of FIG. 10.

With specific reference to FIG. 12, it will be seen that, at the apex of the roof, adjacent tiles 96 have been angularly cut as at 97, near the transverse webs 68 thereof, so that the webs 68 can engage against the roof deck 94 and/or on underlying tile 99 (shown in phantom) to provide support therefor as shown, and that, at the junction of adjacent tiles 96, an appropriate cement, mastic, sealant asphalt, or the like is applied therebetween, to seal the same against penetration of rain, moisture or the like.

Also, in the event that incomplete nailing zones 76, 77, 78, etc. are used, by punching the nailing zones or drilling them through to the top surface 11 of a tile 10, after nails are applied, a suitable sealant pitch, mastic, etc. like that 98 will also be applied thereover, to seal the same against the elements.

It will thus be seen that, in accordance with the present invention, a roof can be covered with tiles without requiring separate accessory tiles, but that such accessories may be made in situ, by making appropriate smaller or partial tiles 95, 96, by cutting the complete tiles 10, and that additional cuts, angled cuts, in connection with hips, eaves, around chimneys, spouts, etc. can be made, all yielding partial tiles with nearby appropriate supporting webs or web portions, near cut edges thereof, in view of the large number of webs present at the bottom of a tile, as can readily be seen from FIG. 2. The interlock groove may be cut off at edges if necessary to provide a regular appearance of a rake edge, such as at 104 in FIG. 10. In connection with all of the foregoing, it will be apparent, while in the preferred manufacture of the present invention, the tiles are constructed of fired clay, it will further be apparent that such tiles can be constructed of various other materials, including molded concrete or cement, molded plastic (preferably reinforced), or molded other synthetic materials, all within the spirit and scope of some embodiments of the present invention.

It will also be apparent that the various recesses 45, 46, 47, 48, 50, 51, 52, 53, 54, 55, 56, 57, 58 and 60, while being described as being recesses or hollow zones, and while being shown, for example in FIG. 2 to be empty or air-filled, such could be filled with a very light material, such as styrene foam or other comparable material that would add essentially no weight to the tile, but which would fill the recesses up to the same level as the outer edges of the webs, to have a uniform planar surface, if desired. Similarly, other materials may be provided in such recesses for comparable purposes.

Figure 13:
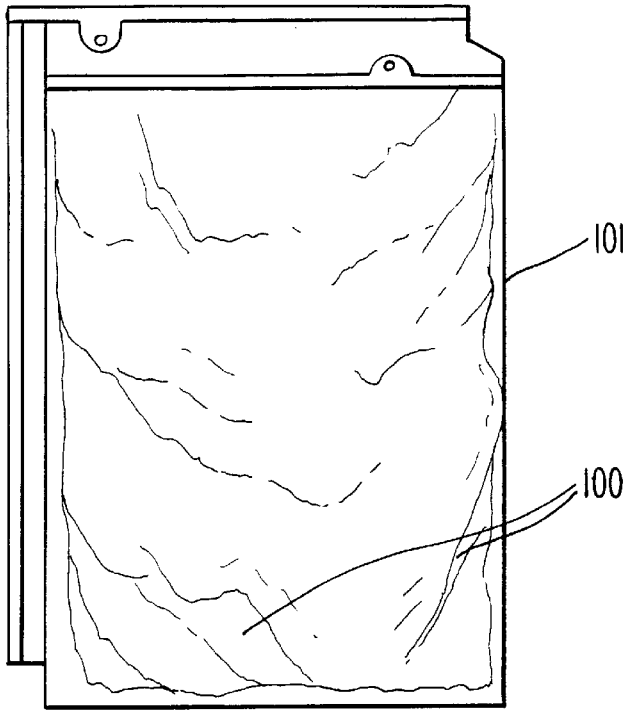
FIG. 13 is a plan view of a tile of the general type of FIG. 1, but wherein relief zones or indicia are illustrated, simulating natural slate on the top surface thereof.
Figure 14:
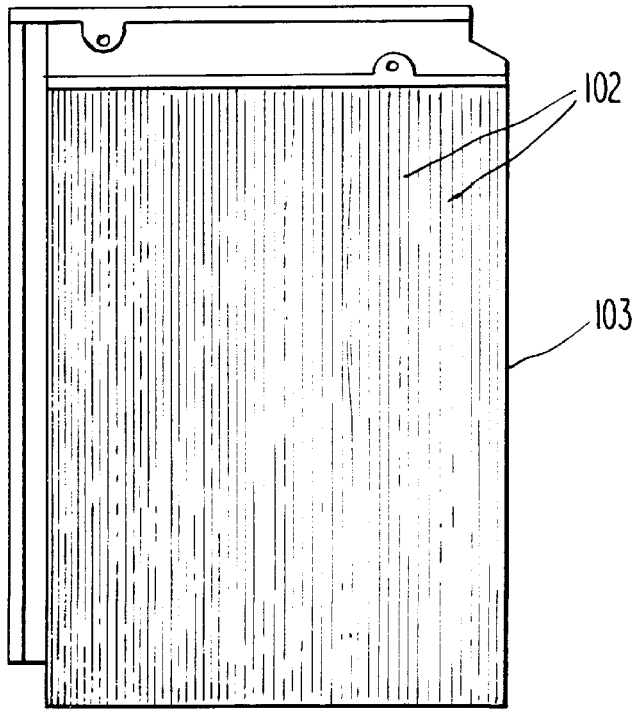
FIG. 14 is a view similar to that of FIG. 13, but wherein relief zones or indicia are illustrated, simulating natural wood shake tiles.

Reference is now made to FIGS. 13 and 14, in which appropriate three-dimensional relief zones such as those 100 indicated on the top surface of a tile 101, are shown to simulate different zones of relief of slate, such that the tile has the indicia or appearance of slate.

With respect to FIG. 14, different zones of relief 102 are indicated in the top surface of the tile 103, simulating the indicia or appearance of wooden shakes.

It will be apparent from the foregoing that the upper, and other exterior surfaces of the tiles may be provided with various other aesthetic markings, indicia, such as relief zones, markings or the like, to simulate various other natural materials.

It will be apparent from the foregoing that other modifications and details of construction, as well as use and assembly of tiles onto roofs will be readily apparent as being within the scope of the invention set forth in the following claims.

What is claimed is:

1. A one-piece molded clay roofing tile, for use on a roof, formed to simulate a tile cut from natural material, the tile having top and bottom cut surfaces connected by edges; with the tile having, disposed beneath the top surface:

a) hollow means in the clay of the tile for reducing the weight of the tile, and b) web means in the tile for strengthening the tile; said web means formed of clay integral with the tile, wherein said web means include a pair of generally spaced-apart, generally parallel webs having adjacent converging web sides that converge toward said top of said tile in a generally inverted, smoothly contoured and curved, U-shaped configuration, said web sides meeting in a common line forming a tile cut line therebetween, with the cut line comprising means facilitating severing of the tile between the pair of webs into two separate smaller tiles, such that each smaller tile has one of the pair of webs providing support therefor along a thus severed edge of the smaller tile.

2. A one-piece molded clay roofing tile, for fixed attachment on a roof, for roofing the roof with a plurality of such tiles, wherein accessory tile pieces are necessary at ends of courses of tiles, at hips and ridges, wherein the clay tile is formed to simulate a tile cut from natural material, the tile having top and bottom surfaces connected by edges; with the tile having disposed beneath the top surface:

a) hollow means in the clay of the tile for reducing the weight of the tile, and b) web means in the tile for strengthening the tile; said web means being formed of clay integral with the tile, wherein said web means further comprises means providing support for the tile along a cut edge of the tile, upon the tile being cut to form a tile accessory piece smaller in size than the tile, said web means additionally comprising adjacent web sides, said web sides meeting in a common line forming a generally inverted, smoothly contoured and curved, U-shaped groove tile cut line, c) a plurality of nailing holes, extending at least partially through the tile, between the top and bottom surfaces thereof, and comprising means for receiving at least one fastener between top and bottom surfaces thereof, for fastening the tile to the roof, with the clay tile having sufficient hollow means and web means to enable the cutting of any necessary tile pieces from tiles in situ during a roofing of a roof with clay tiles, without resort to preformed accessory tile pieces.

3. The tile of claim 2, wherein the tile is of a thickness between top and bottom surfaces, within a range of ½ inch to 1 inch.

4. A one-piece molded clay roofing tile, for fixed attachment on a roof, formed to simulate a tile cut from natural material, the tile having top and bottom surfaces connected by edges; with the tile having disposed beneath the top surface:

a) hollow means in the clay of the tile for reducing the weight of the tile, and b) web means in the tile for strengthening the tile; said web means being formed of clay integral with the tile, wherein said web means further comprises means providing support for the tile along a cut edge of the tile, upon the tile being cut to form a tile accessory piece smaller in size than the tile, said web means additionally comprising adjacent web sides, said web sides meeting in a common line forming a generally inverted, smoothly contoured and curved, U-shaped groove tile cut line;

c) a plurality of nailing holes extending, at least partially through the tile, between the top and bottom surfaces thereof, and comprising means for receiving at least one fastener between top and bottom surfaces thereof, for fastening the tile to the roof;

wherein the hollow means comprises recess means in the bottom surface of the tile, wherein the tile has upper, lower, and side edges and wherein the web means includes at least one web extending between two said edges, comprising a support means facilitating support of the tile upon severing the tile along said web between the two said edges into two partial tiles such that one of the two partial tiles retains the web, providing support therefor along the thus severed edge of the tile wherein the plurality of nailing holes includes a plurality of pre-formed potential nailing zones comprising recesses which are open on the bottom surface of the tile and only partially extending through the thickness of said tile and wherein at least some of said potential nailing zones are provided with reinforcing bosses, integral with the tile and disposed around the nailing zones.

5. The tile of claim 4, wherein there are sufficient hollow means in the tile such that, when a plurality of said tiles are laid in a plurality of partially overlapping courses on a roof, the assembled weight of tiles per square (100 square feet of roof) is in the range of 450 pounds–650 pounds for a tile that is from ½ to 1 inch in thickness between said top and bottom surfaces.

6. The tile of claim 4, wherein the tile has upper, lower and side edges and wherein one side edge is provided with a downwardly extending first lip spaced from the rest of the tile by a first groove, and the other side edge of the tile is provided with an upwardly extending second lip spaced from the rest of the tile by a second groove, with said lips and grooves comprising means enabling interlocking of adjacent left or right tiles of like design, wherein said first lip in said tile is adapted to engage in said second groove in said right adjacent tile and said second lip in said tile is adapted to engage in said first groove of said left adjacent tile whereby adjacent tiles in the roof-mounted condition have their first lips engaged in second grooves and second lips engaged in first grooves, respectively, in interlocked relation.

7. The tile of claim 4, wherein at least the top surface of the tile is provided with zones of random-appearing relief therein, comprising means simulating the irregularities of a natural slate tile.

8. The tile of claim 4, wherein at least the top surface of the tile is provided with zones of random-appearing relief therein, comprising means simulating the irregularities of a wood shake shingle.

9. A one-piece molded clay roofing tile, for fixed attachment on a roof, formed to simulate a tile cut from natural material, the tile having top and bottom surfaces connected by edges; with the tile having, disposed beneath the top surface:

a) hollow means comprising recess means in the bottom surface of the tile in the clay of the tile for reducing the weight of the tile, and b) web means in the tile for strengthening the tile, said web means being formed of clay integral with the tile;

c) a plurality of nailing holes, extending at least partially through the tile, between the top and bottom surfaces thereof, and comprising means for receiving at least one fastener between top and bottom surfaces thereof, for fastening the tile to the roof;

d) wherein said web means include a pair of generally spaced apart webs, meeting in a common line, forming a generally inverted, smoothly contoured and curved, U-shaped groove tile cut line therebetween, with the cut line comprising means facilitating severing of the tile between the pair of webs into two separate smaller tiles, such that each smaller tile has one of the pair of webs providing support therefor along a thus severed edge of a smaller tile;

e) wherein there are sufficient hollow means in the tile such that, when a plurality of said tiles are laid in a plurality of partially overlapping courses on a roof, the assembled weight of tiles per square (100 square feet of roof) is in the range of 450 pounds–650 pounds for a tile that is from ½ to 1 inch in thickness between said top and bottom surfaces;

f) wherein the tile has upper, lower and side edges and wherein said web means comprises a laterally extending web, extending between the side edges of the tile, approximately parallel to the upper and lower edges of the tile, comprising a support means facilitating support of the tile upon severing the tile along said web laterally between side edges thereof into two partial tiles, such that one of the two partial tiles retains the laterally extending web, providing support therefor along the thus severed edge of the tile;

g) wherein one side edge is provided with a downwardly extending first lip spaced from the rest of the tile by a first groove, and the other side edge of the tile is provided with an upwardly extending second lip spaced from the rest of the tile by a second groove, with said lips and grooves comprising means enabling interlocking of adjacent left or right tiles of like design, wherein said first lip in said tile is adapted to engage in said second groove in said right adjacent tile and said second lip in said tile is adapted to engage in said first groove of said left adjacent tile whereby adjacent tiles in the roof-mounted condition have their first lips engaged in second grooves and second lips engaged in first grooves, respectively, in interlocked relation;

h) wherein said pair of webs extend between the upper and lower edges, generally parallel to said side edges as measured along the top surface of the tile.

10. The clay tile of claim 9, wherein the plurality of nailing holes includes a plurality of pre-formed potential nailing holes comprising recesses which are open on the bottom surface of the tile and only partially extending through the thickness of said tile.

11. The clay tile of claim 9, wherein at least top surface of the tile is provided with zones of random-appearing relief therein, comprising means simulating the irregularities of a natural slate tile.

12. The clay of claim 9, wherein at least the top surface of the tile is provided with zones of random-appearing relief therein, comprising means simulating the irregularities of a wood shake shingle.

13. A roof constructed of a plurality of overlapping courses of one-piece molded clay tiles, fixedly attached to the roof, each formed to simulate a tile cut from natural material, with the tiles each having top and bottom surfaces connected by edges; with the tiles each having, disposed beneath their top surfaces:

a) hollow means in the clay of the tile for reducing the weight of the tile, b) web means in the tile for strengthening the tile; said web means being formed integral with the tile, wherein said web means further comprises means providing support for the tile along a cut edge of the tile, upon the tile being cut to form a tile accessory piece smaller in size than the tile, said web means additionally comprising adjacent web sides, said web sides meeting in a common line forming a generally inverted, smoothly contoured and curved, U-shaped groove tile cut line and wherein there are sufficient hollow means in the tiles that the assembled weight of the tiles per square (100 square feet) is in the range of 450 pounds–650 pounds for a tile that is from ½ inch to 1 inch in thickness between said top and bottom surfaces.

14. A roof constructed of a plurality of courses of one-piece molded clay tiles, fixedly attached to the roof, wherein accessory tile pieces are provided at ends of courses of tiles, or at hips and ridges, wherein each said clay tile is formed to simulate a tile cut from natural material, the tiles each having top and bottom surfaces connected by edges; with each complete tile having:

a) hollow means in the clay of the tile for reducing the weight of the tile, and b) web means in the tile for strengthening the tile, wherein said web means further comprises means providing support for the tile along a cut edge of the tile, upon the tile being cut to form a tile accessory piece smaller in size than the tile; said web means additionally comprising adjacent web sides, said web sides meeting in a common line forming a generally inverted, smoothly contoured and curved, U-shaped groove tile cut line;

c) a plurality of nailing holes, extending at least partially through the tile, between the top and bottom surfaces thereof, and comprising means for receiving at least one fastener between top and bottom surfaces thereof, for fastening the tile to the roof.

15. The roof of claim 14, wherein the hollow means in each tile of the roof comprises recess means in the bottom surface of the tile.

16. The roof of claim 14, wherein at least some of said accessory pieces each comprise a portion of a complete tile, cut from a complete tile and having at least one cut edge resulting from the accessory tile being cut from the complete tile, wherein said web means in at least some of said accessory pieces includes a web extending along a said cut edge, comprising means supporting said cut edge of said accessory piece.

17. A method of roofing a roof with a plurality of one-piece molded tiles, comprising the steps of:

a) providing a plurality of tiles, each having top and bottom surfaces connected by edges, with the tiles each having disposed beneath their top surfaces:

i) hollow means in the tile for reducing the weight of the tile, and ii) web means in the form of two webs in the tile, accessible from the bottom surface of the tile, for strengthening the tile; said webs being formed of clay integral with the tile, and said two webs comprise adjacent parallel webs having converging web sides that converge toward said top of said tile, said web sides meeting in a common line forming generally inverted, smoothly contoured and curved, U-shaped groove tile cut line, b) laying the tiles on a roof in a plurality of courses, with upper headlap portions of tiles in each lower course being partially covered by lower, exposed portions of tiles in a next-applied upper course;

c) securing the tiles in each course to the roof by fasteners;

d) cutting accessory pieces from complete tiles for use at locations on the roof where less than complete tiles are called for;

e) with the cutting of at least some of the accessory pieces being along the cut lines intermediate between and parallel to webs accessible from the bottom surfaces of the tiles, to yield accessory pieces in the form of partial tiles, wherein the cutting is along the top of the generally inverted U-shaped configuration;

f) securing the partial tiles to the roof by fasteners.

18. A method of roofing a roof with a plurality of one-piece molded tiles fixedly attached to the roof, comprising the steps of:

a) providing a plurality of tiles, each having top and bottom surfaces connected by edges, with the tiles each having disposed beneath their top surfaces:

i) hollow means reducing the weight of the tile, and ii) web means in the form of webs in the tile, accessible from the bottom surface of the tile, for strengthening the tile; said web means being formed of clay integral with the tile, wherein said web means further comprises means providing support for the tile along a cut edge of the tile, upon the tile being cut to form a tile accessory piece smaller in size than the tile, said web means additionally comprising adjacent web sides, said web sides meeting in a common line forming a generally inverted, smoothly contoured and curved, U-shaped groove tile cut line wherein at least some of the cut lines are formed between a pair of parallel webs in a given tile, for separating said tile into two tile accessory pieces upon cutting said tile along said cut line, and with the two accessory pieces then being applied at different locations on the roof where less than complete tiles are called for;

b) laying the tiles on a roof in a plurality of courses, with upper headlap portions of tiles in each lower course being partially covered by lower, exposed portions of tiles in a next-applied upper course;

c) securing the tiles in each course to the roof by fasteners;

d) cutting accessory pieces from complete tiles for use at locations on the roof where less than complete tiles are called for;

e) cutting at least some of the accessory pieces along cut lines parallel to webs accessible from the bottom surfaces of the tiles, to yield accessory pieces in the form of partial tiles;

f) securing the partial tiles to the roof by fasteners.

19. The method of claim 18, wherein each tile has upper, lower and side edges, and wherein one side edge is provided with a downwardly extending first lip spaced from the rest of the tile by a first groove, and the other side edge of the tile is provided with an upwardly extending second lip spaced from the rest of the tile by a second groove, and laying adjacent tiles in a course with first lips of one tile engaged in second grooves of an adjacent tile, and with second lips of tiles engaged in first grooves of adjacent tiles, respectively, in interlocked relation.

* * * * *